US007318027B2

(12) United States Patent
Lennon et al.

(10) Patent No.: US 7,318,027 B2
(45) Date of Patent: Jan. 8, 2008

(54) CONVERSION OF SYNTHESIZED SPECTRAL COMPONENTS FOR ENCODING AND LOW-COMPLEXITY TRANSCODING

(75) Inventors: Brian Timothy Lennon, Nashville, TN (US); Michael Mead Truman, San Francisco, CA (US); Robert Loring Andersen, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 861 days.

(21) Appl. No.: 10/458,798

(22) Filed: Jun. 9, 2003

(65) Prior Publication Data

US 2004/0165667 A1 Aug. 26, 2004

Related U.S. Application Data

(60) Provisional application No. 60/445,931, filed on Feb. 6, 2003.

(51) Int. Cl.
*G10L 19/14* (2006.01)
*G10L 21/00* (2006.01)

(52) U.S. Cl. ..... 704/229; 704/E19.049; 704/200.1; 704/500

(58) Field of Classification Search ..... 704/200.1, 704/229, 500, 501
See application file for complete search history.

(56) References Cited

U.S. PATENT DOCUMENTS

| | | | |
|---|---|---|---|
| 3,684,838 | A | 8/1972 | Kahn |
| 3,880,490 | A | 4/1975 | Belmont |
| 3,995,115 | A | 11/1976 | Kelly |
| 4,610,022 | A | 9/1986 | Kitayama |
| 4,667,340 | A | 5/1987 | Arjmand et al. |
| 4,757,517 | A | 7/1988 | Yatsuzuka |
| 4,776,014 | A | 10/1988 | Zinser, Jr. |
| 4,790,016 | A | 12/1988 | Mazor et al. |
| 4,885,790 | A | 12/1989 | McAulay et al. |
| 4,914,701 | A | 4/1990 | Zibman |

(Continued)

FOREIGN PATENT DOCUMENTS

| | | |
|---|---|---|
| DE | 4121137 | 1/1993 |

(Continued)

OTHER PUBLICATIONS

Liu, Chi-Min, et al.; "Design of the Coupling Schemes for the Dolby AC-3 Coder in Stereo Coding", Int. Conf. on Consumer Electronics, ICCE, Jun. 2, 1998, pp. 328-329.*

(Continued)

*Primary Examiner*—Patrick N. Edouard
*Assistant Examiner*—Joel Stoffregen
(74) *Attorney, Agent, or Firm*—David N. Lathrop, Esq.; Gallagher & Lathrop

(57) ABSTRACT

In an audio coding system, an encoding transmitter represents encoded spectral components as normalized floating-point numbers. The transmitter provides first and second control parameters that may be used to transcode the encoded spectral parameters. A transcoder uses first control parameters to partially decode the encoded components and uses second control parameters to re-encode the components. The transmitter determines the second control parameters by analyzing the effects of arithmetic operations in the partial-decoding process to identify situations where the floating-point representations lose normalization. Exponents associated with the numbers that lose normalization are modified and the modified exponents are used to calculate the second control parameters.

36 Claims, 3 Drawing Sheets

U.S. PATENT DOCUMENTS

| | | | | |
|---|---|---|---|---|
| 4,935,963 | A | 6/1990 | Jain | |
| 5,001,758 | A | 3/1991 | Galand et al. | |
| 5,054,072 | A | 10/1991 | McAulay et al. | |
| 5,054,075 | A | 10/1991 | Hong et al. | |
| 5,109,417 | A | 4/1992 | Fielder et al. | |
| 5,127,054 | A | 6/1992 | Hong et al. | |
| 5,246,382 | A | 9/1993 | Kerek et al. | |
| 5,394,473 | A | 2/1995 | Davidson | |
| 5,583,962 | A | 12/1996 | Davis et al. | |
| 5,636,324 | A * | 6/1997 | Teh et al. | 704/226 |
| 5,718,601 | A | 2/1998 | Masters et al. | |
| 5,845,251 | A * | 12/1998 | Case | 704/500 |
| 5,852,805 | A * | 12/1998 | Hiratsuka et al. | 704/500 |
| 5,970,461 | A * | 10/1999 | Chatterton | 704/500 |
| RE36,478 | E | 12/1999 | McAulay et al. | |
| 6,341,165 | B1 | 1/2002 | Brandenburg et al. | |
| 6,424,939 | B1 | 7/2002 | Herre | |
| 6,775,587 | B1 * | 8/2004 | Absar et al. | 704/200.1 |
| 2003/0014241 | A1 * | 1/2003 | Ferris et al. | 704/200.1 |
| 2003/0028386 | A1 * | 2/2003 | Zinser et al. | 704/500 |

FOREIGN PATENT DOCUMENTS

| | | |
|---|---|---|
| DE | 19509149 | 9/1996 |
| EP | 0746116 | 4/1996 |
| EP | 833405 | 4/1998 |
| EP | 847107 | 6/1998 |
| WO | WO 9857436 | 12/1998 |
| WO | WO 0045379 | 8/2000 |
| WO | WO 0191111 | 11/2001 |
| WO | WO-02/41302 | 5/2002 |

OTHER PUBLICATIONS

Hans, M., et al., "An MPEG Audio Layered Transcoder" preprints of papers presented at the AES Convention, XX, XX, Sep. 1998, pp. 1-18.

Nakajima, Y., et al. "MPEG Audio Bit Rate Scaling On Coded Data Domain" Acoustics, Speech and Signal Processing, 1998, Proceedings of the 1998 IEEE Int'l. Conf. on Seattle, WA, May 12-15, 1998, New York IEEE pp. 3669-3672.

Ehret, A., et al., "Technical Description of Coder Technologies' Proposal for MPEG-4 v3 General Audio Bandwidth Extension: Spectral Band Replication (SBR)", Coding Technologies AB/GmbH.

Liu, Chi-Min, et al.; "Design of the Coupling Schemes for the Dolby AC-3 Coding in Stereo Coding", Int. Conf. on Consumer Electronics, ICCE, Jun. 2, 1998, IEEE XP010283089; pp. 328-329.

Atkinson, I. A.; et al., "Time Envelope LP Vocoder: A New Coding Technique at Very Low Bit Rates,"4th European Conf on Speech Comm. & Tech., ESCA Eurospeech Sep. 1995 Madrid, ISSN 1018-4074, pp. 241-244.

ATSC Standard: Digital Audio Compression (AC-3), Revision A, Aug. 20, 2001, Sections 1-4, 6, 7.3 and 8.

Bosi, et al., "ISO/IEC MPEG-2 Advanced Audio Coding," J. Audio Eng. Soc., vol. 45, No. 10, Oct. 1997, pp. 789-814.

Edler, "Codierung von Audiosignalen mit uberlappender Transformation und Adaptivene Fensterfunktionen," Frequenz, 1989, vol. 43, pp. 252-256.

Galand, et al.; "High-Frequency Regeneration of Base-Band Vocoders by Multi-pulse Excitation" IEEE Int. Conf. Sys. (ICASSP 87), Apr. 1987, pp. 1934-1937.

Grauel, Christoph, "Sub-Band Coding with Adaptive Bit Allocation," Signal Processing, vol. 2 No. 1, Jan. 1980, No. Holland Publishing Co., ISSN 0 165-1684, pp. 23-30.

Herre, et al., "Enhancing the Performance of Perceptual Audio Coders by Using Temporal Noise Shaping (TNS)," 101st AES Convention, Nov. 1996, preprint 4384.

Herre, et al., "Exploiting Both Time and Frequency Structure in a System That Uses an Analysis/Synthesis Filterbank with High Frequency Resolution," 103rd AES Convention, Sep. 1997, preprint 4519.

Herre, et al., "Extending the MPEG-4 AAC Codec by Perceptual Noise Substitution," 104th AES Convention, May 1998, preprint 4720.

Laroche, et al., "New phase-Vocoder Techniques for Pitch-Shifting, Harmonizing and Other Exotic Effects" Proc. IEEE Workshop on Applications of Signal Processing to Audio and Acoustics, New Paltz, new York, Oct. 17-20, 1999, p. 91-94.

Makhoul, et al.; "High-Frequency Regeneration in Speech Coding Systems" IEEE Int. Conf. Sys. (ICASSP 79), Mar. 1979, pp. 428-431.

Rabiner, et al., "Digital Processing of Speech Signals,": Prentice-Hall, 1978, pp. 396-404.

Stott, Jonathan, "DRM-key technical features" EBU Technical Review, Mar. 2001, pp. 1-24.

Sugiyama, et. al., "Adaptive Transform Coding With an Adaptive Block Size (ATC-ABS)", IEEE Intl. Conf£ on Acoust., Speech, and Sig. Proc., Apr. 1990.

Zinser, R. L., "An Efficient, Pitch-Aligned High-Frequency Regeneration Technique for RELP Vocoders" IEEE 1985, p. 969-972.

* cited by examiner

CONVERSION OF SYNTHESIZED SPECTRAL COMPONENTS FOR ENCODING AND LOW-COMPLEXITY TRANSCODING

TECHNICAL FIELD

The present invention generally pertains to audio coding methods and devices, and more specifically pertains to improved methods and devices for encoding and transcoding audio information.

BACKGROUND ART

A. Coding

Many communications systems face the problem that the demand for information transmission and recording capacity often exceeds the available capacity. As a result, there is considerable interest among those in the fields of broadcasting and recording to reduce the amount of information required to transmit or record an audio signal intended for human perception without degrading its perceived quality. There is also an interest to improve the perceived quality of the output signal for a given bandwidth or storage capacity.

Traditional methods for reducing information capacity requirements involve transmitting or recording only selected portions of the input signal. The remaining portions are discarded. Techniques known as perceptual encoding typically convert an original audio signal into spectral components or frequency subband signals so that those portions of the signal that are either redundant or irrelevant can be more easily identified and discarded. A signal portion is deemed to be redundant if it can be recreated from other portions of the signal. A signal portion is deemed to be irrelevant if it is perceptually insignificant or inaudible. A perceptual decoder can recreate the missing redundant portions from an encoded signal but it cannot create any missing irrelevant information that was not also redundant. The loss of irrelevant information is acceptable in many applications, however, because its absence has no perceptible effect on the decoded signal.

A signal encoding technique is perceptually transparent if it discards only those portions of a signal that are either redundant or perceptually irrelevant. One way in which irrelevant portions of a signal may be discarded is to represent spectral components with lower levels of accuracy, which is often referred to as quantization. The difference between an original spectral component and its quantized representation is known as quantization noise. Representations with a lower accuracy have a higher level of quantization noise. Perceptual encoding techniques attempt to control the level of the quantization noise so that it is inaudible.

If a perceptually transparent technique cannot achieve a sufficient reduction in information capacity requirements, then a perceptually non-transparent technique is needed to discard additional signal portions that are not redundant and are perceptually relevant. The inevitable result is that the perceived fidelity of the transmitted or recorded signal is degraded. Preferably, a perceptually non-transparent technique discards only those portions of the signal deemed to have the least perceptual significance.

An encoding technique referred to as "coupling," which is often regarded as a perceptually non-transparent technique, may be used to reduce information capacity requirements. According to this technique, the spectral components in two or more input audio signals are combined to form a coupled-channel signal with a composite representation of these spectral components. Side information is also generated that represents a spectral envelope of the spectral components in each of the input audio signals that are combined to form the composite representation. An encoded signal that includes the coupled-channel signal and the side information is transmitted or recorded for subsequent decoding by a receiver. The receiver generates decoupled signals, which are inexact replicas of the original input signals, by generating copies of the coupled-channel signal and using the side information to scale spectral components in the copied signals so that the spectral envelopes of the original input signals are substantially restored. A typical coupling technique for a two-channel stereo system combines high-frequency components of the left and right channel signals to form a single signal of composite high-frequency components and generates side information representing the spectral envelopes of the high-frequency components in the original left and right channel signals. One example of a coupling technique is described in "Digital Audio Compression (AC-3)," Advanced Television Systems Committee (ATSC) Standard document A/52 (1994), which is referred to herein as the A/52 Document and is incorporated by reference in its entirety.

An encoding technique known as spectral regeneration is a perceptually non-transparent technique that may be used to reduce information capacity requirements. In many implementations, this technique is referred to as "high-frequency regeneration" (HFR) because only high-frequency spectral components are regenerated. According to this technique, a baseband signal containing only low-frequency components of an input audio signal is transmitted or stored. Side information is also provided that represents a spectral envelope of the original high-frequency components. An encoded signal that includes the baseband signal and the side information is transmitted or recorded for subsequent decoding by a receiver. The receiver regenerates the omitted high-frequency components with spectral levels based on the side information and combines the baseband signal with the regenerated high-frequency components to produce an output signal. A description of known methods for HFR can be found in Makhoul and Berouti, "High-Frequency Regeneration in Speech Coding Systems", *Proc. of the International Conf. on Acoust., Speech and Signal Proc.*, April 1979. Improved spectral regeneration techniques that are suitable for encoding high-quality music are disclosed in U.S. patent application Ser. No. 10/113,858 entitled "Broadband Frequency Translation for High Frequency Regeneration" filed Mar. 28, 2002, U.S. patent application Ser. No. 10/174,493 entitled "Audio Coding System Using Spectral Hole Filling" filed Jun. 17, 2002, U.S. patent application Ser. No. 10/238,047 entitled "Audio Coding System Using Characteristics of a Decoded Signal to Adapt Synthesized Spectral Components" filed Sep. 6, 2002, and U.S. patent application Ser. No. 10/434,449 entitled "Improved Audio Coding Systems and Methods Using Spectral Component Coupling and Spectral Component Regeneration" filed May 8, 2003, which are incorporated by reference in their entirety.

B. Transcoding

Known coding techniques have reduced the information capacity requirements of audio signals for given level of perceived quality or, conversely, have improved the perceived quality of audio signals having a specified information capacity. Despite this success, demands for further advancement exist and coding research continues to discover new coding techniques and to discover new ways to use known techniques.

One consequence of further advancements is a potential incompatibility between signals that are encoded by newer coding techniques and existing equipment that implements older coding techniques. Although much effort has been made by standards organizations and equipment manufacturers to prevent premature obsolescence, older receivers cannot always correctly decode signals that are encoded by newer coding techniques. Conversely, newer receivers cannot always correctly decode signals that are encoded by older coding techniques. As a result, both professionals and consumers acquire and maintain many pieces of equipment if they wish to ensure compatibility with signals encoded by older and newer coding techniques.

One way in which this burden can be eased or avoided is to acquire a transcoder that can convert encoded signals from one format to another. A transcoder can serve as a bridge between different coding techniques. For example, a transcoder can convert a signal that is encoded by a new coding technique into another signal that is compatible with receivers that can decode only those signals that are encoded by an older technique.

Conventional transcoding implements complete decoding and encoding processes. Referring to the transcoding example mentioned above, an input encoded signal is decoded using a newer decoding technique to obtain spectral components that are then converted into a digital audio signal by synthesis filtering. The digital audio signal is then converted into spectral components again by analysis filtering, and these spectral components are then encoded using an older encoding technique. The result is an encoded signal that is compatible with older receiving equipment. Transcoding may also be used to convert from older to newer formats, to convert between different contemporary formats and to convert between different bit rates of the same format.

Conventional transcoding techniques have serious disadvantages when they are used to convert signals that are encoded by perceptual coding systems. One disadvantage is that conventional transcoding equipment is relatively expensive because it must implement complete decoding and encoding processes. A second disadvantage is that the perceived quality of the transcoded signal after decoding is almost always degraded relative to the perceived quality of the input encoded signal after decoding.

DISCLOSURE OF INVENTION

It is an object of the present invention to provide coding techniques that can be used to improve the quality of transcoded signals and to allow transcoding equipment to be implemented less expensively.

This object is achieved by the present invention as set forth in the claims. A transcoding technique decodes an input encoded signal to obtain spectral components and then encodes the spectral components into an output encoded signal. Implementation costs and signal degradation incurred by synthesis and analysis filtering are avoided. Implementation costs of the transcoder may be further reduced by providing control parameters in the encoded signal rather than have the transcoder determine these control parameters for itself.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Overview

A basic audio coding system includes an encoding transmitter, a decoding receiver, and a communication path or recording medium. The transmitter receives an input signal representing one or more channels of audio and generates an encoded signal that represents the audio. The transmitter then transmits the encoded signal to the communication path for conveyance or to the recording medium for storage. The receiver receives the encoded signal from the communication path or recording medium and generates an output signal that may be an exact or approximate replica of the original audio. If the output signal is not an exact replica, many coding systems attempt to provide a replica that is perceptually indistinguishable from the original input audio.

An inherent and obvious requirement for proper operation of any coding system is that the receiver must be able to correctly decode the encoded signal. Because of advances in coding techniques, however, situations arise where it is desirable to use a receiver to decode a signal that has been encoded by coding techniques that the receiver cannot correctly decode. For example, an encoded signal may have been generated by an encoding technique that expects the decoder to perform spectral regeneration but a receiver cannot perform spectral regeneration. Conversely, an encoded signal may have been generated by an encoding technique that does not expect the decoder to perform spectral regeneration but a receiver expects and requires an encoded signal that needs spectral regeneration. The present invention is directed toward transcoding that can provide a bridge between incompatible coding techniques and coding equipment.

A few coding techniques are described below as an introduction to a detailed description of some ways in which the present invention may be implemented.

1. Basic System a) Encoding Transmitter

Figure 1:
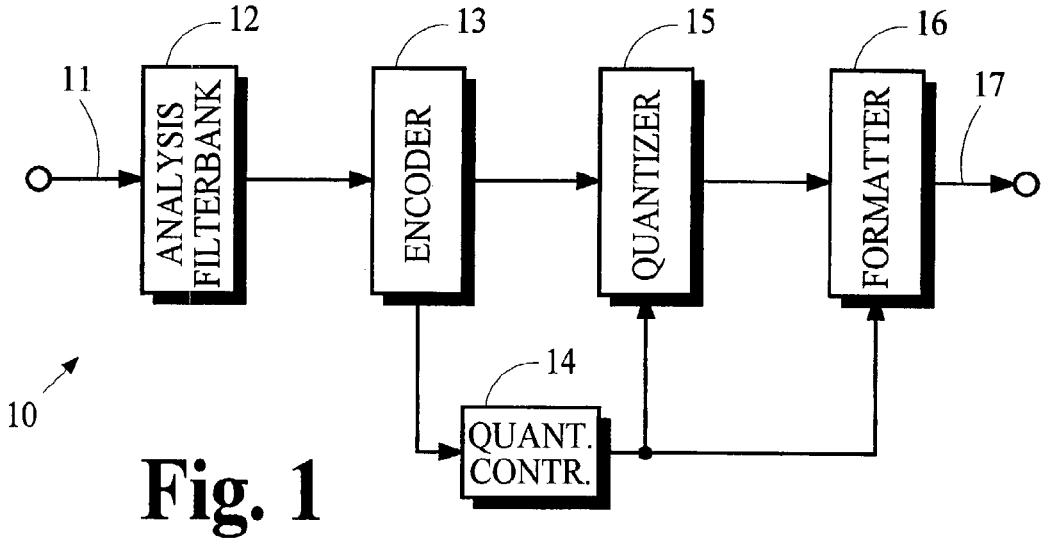
FIG. 1 is a schematic diagram of an audio encoding transmitter.

FIG. 1 is a schematic illustration of one implementation of a split-band audio encoding transmitter 10 that receives from the path 11 an input audio signal. The analysis filterbank 12 splits the input audio signal into spectral components that represent the spectral content of the audio signal.

The encoder 13 performs a process that encodes at least some of the spectral components into coded spectral information. Spectral components that are not encoded by the encoder 13 are quantized by the quantizer 15 using a quantizing resolution that is adapted in response to control parameters received from the quantizing controller 14. Optionally, some or all of the coded spectral information may also be quantized. The quantizing controller 14 derives the control parameters from detected characteristics of the input audio signal. In the implementation shown, the detected characteristics are obtained from information provided by the encoder 13. The quantizing controller 14 may also derive the control parameters in response to other characteristics of the audio signal including temporal characteristics. These characteristics may be obtained from an analysis of the audio signal prior to, within or after processing performed by the analysis filterbank 12. Data representing the quantized spectral information, the coded spectral information and data representing the control parameters are assembled by the formatter 16 into an encoded signal, which is passed along the path 17 for transmission or storage. The formatter 16 may also assemble other data into the encoded signal such as synchronization words, parity or error detection codes, database retrieval keys, and auxiliary signals, which are not pertinent to an understanding of the present invention and are not discussed further.

The encoded signal may be transmitted by baseband or modulated communication paths throughout the spectrum including from supersonic to ultraviolet frequencies, or it may be recorded on media using essentially any recording technology including magnetic tape, cards or disk, optical cards or disc, and detectable markings on media like paper.

(1) Analysis Filterbank

The analysis filterbank 12 and the synthesis filterbank 25, discussed below, may be implemented in essentially any way that is desired including a wide range of digital filter technologies, block transforms and wavelet transforms. In one audio coding system, the analysis filterbank 12 is implemented by a Modified Discrete Cosine Transform (MDCT) and the synthesis filterbank 25 is implemented by an Inverse Modified Discrete Cosine Transform (IMDCT) that are described in Princen et al., "Subband/Transform Coding Using Filter Bank Designs Based on Time Domain Aliasing Cancellation," *Proc. of the International Conf on Acoust., Speech and Signal Proc.*, May 1987, pp. 2161-64. No particular filterbank implementation is important in principle.

Analysis filterbanks that are implemented by block transforms split a block or interval of an input signal into a set of transform coefficients that represent the spectral content of that interval of signal. A group of one or more adjacent transform coefficients represents the spectral content within a particular frequency subband having a bandwidth commensurate with the number of coefficients in the group.

Analysis filterbanks that are implemented by some type of digital filter such as a polyphase filter, rather than a block transform, split an input signal into a set of subband signals. Each subband signal is a time-based representation of the spectral content of the input signal within a particular frequency subband. Preferably, the subband signal is decimated so that each subband signal has a bandwidth that is commensurate with the number of samples in the subband signal for a unit interval of time.

The following discussion refers more particularly to implementations that use block transforms like the Time Domain Aliasing Cancellation (TDAC) transform mentioned above. In this discussion, the term "spectral components" refers to the transform coefficients and the terms "frequency subband" and "subband signal" pertain to groups of one or more adjacent transform coefficients. Principles of the present invention may be applied to other types of implementations, however, so the terms "frequency subband" and "subband signal" pertain also to a signal representing spectral content of a portion of the whole bandwidth of a signal, and the term "spectral components" generally may be understood to refer to samples or elements of the subband signal. Perceptual coding systems usually implement the analysis filterbank to provide frequency subbands having bandwidths that are commensurate with the so called critical bandwidths of the human auditory system.

(2) Coding

The encoder 13 may perform essentially any type of encoding process that is desired. In one implementation, the encoding process converts the spectral components into a scaled representation comprising scaled values and associated scale factors, which is discussed below. In other implementations, encoding processes like matrixing or the generation of side information for spectral regeneration or coupling may also be used. Some of these techniques are discussed in more detail below.

The transmitter 10 may include other coding processes that are not suggested by FIG. 1. For example, the quantized spectral components may be subjected to an entropy coding process such as arithmetic coding or Huffinan coding. A detailed description of coding processes like these is not needed to understand the present invention.

(3) Quantization

The resolution of the quantizing provided by the quantizer 15 is adapted in response to control parameters received from the quantizing controller 14. These control parameters may be derived in any way desired; however, in a perceptual encoder, some type of perceptual model is used to estimate how much quantization noise can be masked by the audio signal to be encoded. In many applications, the quantizing controller is also responsive to restrictions imposed on the information capacity of the encoded signal. This restriction is sometimes expressed in terms of a maximum allowable bit rate for the encoded signal or for a specified part of the encoded signal.

In preferred implementations of perceptual coding systems, the control parameters are used by a bit allocation process to determine the number of bits to allocate to each spectral component and to determine the quantizing resolutions that the quantizer 15 uses to quantize each spectral component so that the audibility of quantization noise is minimized subject to information capacity or bit-rate restrictions. No particular implementation of the quantizing controller 14 is critical to the present invention.

One example of a quantizing controller is disclosed in the A/52 Document, which describes a coding system sometimes referred to as Dolby AC-3. In this implementation, spectral components of an audio signal are represented by a scaled representation in which scale factors provide an estimate of the spectral shape of the audio signal. A perceptual model uses the scale factors to calculate a masking curve that estimates masking effects of the audio signal. The quantizing controller then determines an allowable noise threshold, which controls how spectral components are quantized so that quantization noise is distributed in some optimum fashion to meet an imposed information capacity limit or bit rate. The allowable noise threshold is a replica of the masking curve and is offset from the masking curve by an amount determined by the quantizing controller. In this implementation, the control parameters are the values that define the allowable noise threshold. These parameters may be expressed in a number of ways such as a direct expression of the threshold itself or as values like the scale factors and an offset from which the allowed noise threshold can be derived.

b) Decoding Receiver

Figure 2:
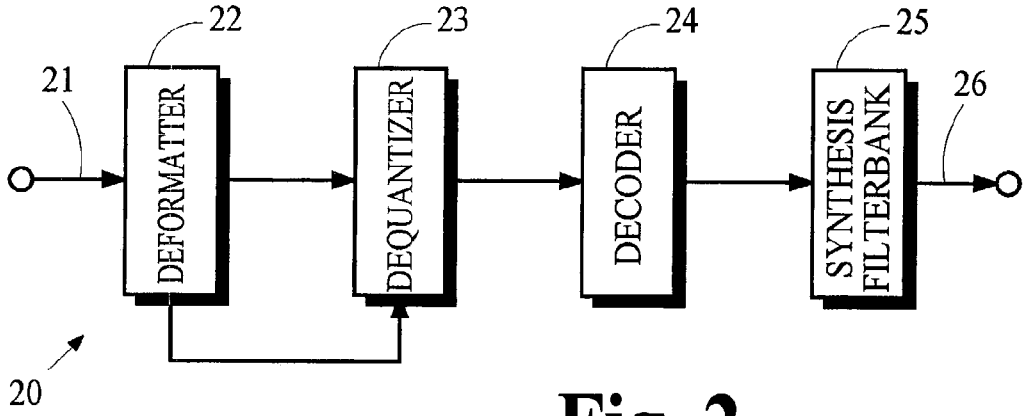
FIG. 2 is a schematic diagram of an audio decoding receiver.

FIG. 2 is a schematic illustration of one implementation of a split-band audio decoding receiver 20 that receives from path 21 an encoded signal representing an audio signal. The deformatter 22 obtains quantized spectral information, coded spectral information and control parameters from the encoded signal. The quantized spectral information is dequantized by the dequantizer 23 using a resolution that is adapted in response to the control parameters. Optionally, some or all of the coded spectral information may also be dequantized. The coded spectral information is decoded by the decoder 24 and combined with the dequantized spectral components, which are converted into an audio signal by the synthesis filterbank 25 and passed along path 26.

The processes performed in the receiver are complementary to corresponding processes performed in the transmitter. The deformatter 22 disassembles what was assembled by the formatter 16. The decoder 24 performs a decoding process that is either an exact inverse or a quasi-inverse of the encoding process performed by the encoder 13, and the dequantizer 23 performs a process that is a quasi-inverse of the process performed by the quantizer 15. The synthesis filterbank 25 carries out a filtering process that is inverse to that carried out by the analysis filterbank 12. The decoding and dequantizing processes are said to be a quasi-inverse process because they may not provide a perfect reversal of the complementary processes in the transmitter.

In some implementations, synthesized or pseudo-random noise can be inserted into some of the least significant bits of dequantized spectral components or used as a substitute for one or more spectral components. The receiver may also perform additional decoding processes to account for any other coding that may have been performed in the transmitter.

c) Transcoder

Figure 3:
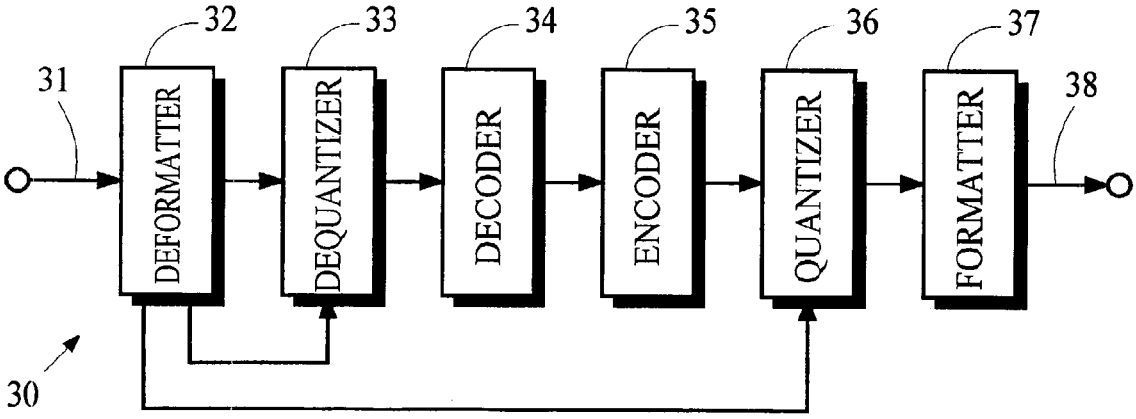
FIG. 3 is a schematic diagram of a transcoder.

FIG. 3 is a schematic illustration of one implementation of a transcoder 30 that receives from path 31 an encoded signal representing an audio signal. The deformatter 32 obtains quantized spectral information, coded spectral information, one or more first control parameters and one or more second control parameters from the encoded signal. The quantized spectral information is dequantized by the dequantizer 33 using a resolution that is adapted in response to the one or more first control parameters received from the encoded signal. Optionally, some or all of the coded spectral information may also be dequantized. If necessary, all or some of the coded spectral information may be decoded by the decoder 34 for transcoding.

The encoder 35 is an optional component that may not be needed for a particular transcoding application. If necessary, encoder 35 performs a process that encodes at least some of the dequantized spectral information, or coded and/or decoded spectral information, into re-encoded spectral information. Spectral components that are not encoded by the encoder 35 are re-quantized by the quantizer 36 using a quantizing resolution that is adapted in response to the one or more second control parameters received from the encoded signal. Optionally, some or all of the re-encoded spectral information may also be quantized. Data representing the re-quantized spectral information, the re-encoded spectral information and data representing the one or more second control parameters are assembled by the formatter 37 into an encoded signal, which is passed along the path 38 for transmission or storage. The formatter 37 may also assemble other data into the encoded signal as discussed above for the formatter 16.

The transcoder 30 is able to perform its operations more efficiently because no computational resources are required to implement a quantizing controller to determine the first and second control parameters. The transcoder 30 may include one or more quantizer controllers like the quantizing controller 14 described above to derive the one or more second control parameters and/or the one or more first control parameters rather than obtain these parameters from the encoded signal. Features of the encoding transmitter 10 that are needed to determine the first and second control parameters are discussed below.

2. Representation of Values (1) Scaling

Audio coding systems typically must represent audio signals with a dynamic range that exceeds 100 dB. The number of bits needed for a binary representation of an audio signal or its spectral components that can express this dynamic range is proportional to the accuracy of the representation. In applications like the conventional compact disc, pulse-code modulated (PCM) audio is represented by sixteen bits. Many professional applications use even more bits, 20 or 24 bits for example, to represent PCM audio with greater dynamic range and higher precision.

An integer representation of an audio signal or its spectral components is very inefficient and many coding systems use another type of representation that includes a scaled value and an associated scale factor of the form $$s=v\cdot f \tag{1}$$

where s=the value of an audio component;

v=a scaled value; and f=the associated scale factor.

The scaled value v may be expressed in essentially any way that may be desired including fractional representations and integer representations. Positive and negative values may be represented in a variety of ways including sign-magnitude and various complement representations like one's complement and two's complement for binary numbers. The scale factor f may be a simple number or it may be essentially any function such as an exponential function $g^f$ or logarithmic function $\log_g f$, where g is the base of the exponential and logarithmic functions.

In a preferred implementation suitable for use in many digital computers, a particular floating-point representation is used in which a "mantissa" m is the scaled value, expressed as a binary fraction using a two's complement representation, and an "exponent" x represents the scale factor, which is the exponential function $2^{-x}$. The remainder of this disclosure refers to floating-point mantissas and exponents; however, it should be understood that this particular representation is merely one way in which the present invention may be applied to audio information represented by scaled values and scale factors.

The value of an audio signal component is expressed in this particular floating-point representation as follows:

$$s=m\cdot 2^{-x} \tag{2}$$

For example, suppose a spectral component has a value equal to $0.17578125_{10}$, which is equal to the binary fraction $0.00101101_2$. This value can be represented by many pairs of mantissas and exponents as shown in Table I.

TABLE I

| Mantissa (m) | Exponent (x) | Expression |
|---|---|---|
| $0.00101101_2$ | 0 | $0.00101101_2 \times 2^0 = 0.17578125 \times 1 = 0.17578125$ |
| $0.0101101_2$ | 1 | $0.0101101_2 \times 2^{-1} = 0.3515625 \times 0.5 = 0.17578125$ |
| $0.101101_2$ | 2 | $0.101101_2 \times 2^{-2} = 0.703125 \times 0.25 = 0.17578125$ |
| $1.01101_2$ | 3 | $1.01101_2 \times 2^{-3} = 1.40625 \times 0.125 = 0.17578125$ |

In this particular floating-point representation, a negative number is expressed by a mantissa having a value that is the two's complement of the magnitude of the negative number. Referring to the last row shown in Table I, for example, the binary fraction $1.01101_2$ in a two's complement representation expresses the decimal value −0.59375. As a result, the value actually represented by the floating-point number shown in the last row of the table is $-0.59375\times 2^{-3}=-0.07421875$, which differs from the intended value shown in the table. The significance of this aspect is discussed below.

(2) Normalization

The value of a floating-point number can be expressed with fewer bits if the floating-point representation is "normalized." A non-zero floating-point representation is said to be normalized if the bits in a binary expression of the mantissa have been shifted into the most-significant bit positions as far as possible without losing any information about the value. In a two's complement representation, normalized positive mantissas are always greater than or equal to +0.5 and less than +1, and normalized negative mantissas are always less than −0.5 and greater than or equal to −1. This is equivalent to having the most significant bit being not equal to the sign bit. In Table I, the floating-point representation in the third row is normalized. The exponent x for the normalized mantissa is equal to 2, which is the number of bit shifts required to move a one-bit into the most-significant bit position.

Suppose a spectral component has a value equal to the decimal fraction −0.17578125, which is equal to the binary number $1.11010011_2$. The initial one-bit in the two's complement representation indicates the value of the number is negative. This value may be represented as a floating-point number having a normalized mantissa $m=1.010011_2$. The exponent x for this normalized mantissa is equal to 2, which is the number of bit shifts required to move a zero-bit into the most-significant bit position.

The floating-point representation shown in the first, second and last rows of Table I are unnormalized representations. The representations shown in the first two rows of the table are "under-normalized" and the representation shown in the last row of the table is "over-normalized."

For coding purposes, the exact value of a mantissa of a normalized floating-point number can be represented with fewer bits. For example, the value of the unnormalized mantissa $m=0.00101101_2$ can be represented by nine bits. Eight bits are needed to represent the fractional value and one bit is needed to represent the sign. The value of the normalized mantissa $m=0.101101_2$ can be represented by only seven bits. The value of the over-normalized mantissa $m=1.01101_2$ shown in the last row of Table I can be represented by even fewer bits; however, as explained above, a floating-point number with an over-normalized mantissa no longer represents the correct value.

These examples help illustrate why it is usually desirable to avoid under-normalized mantissas and why it is usually critical to avoid over-normalized mantissas. The existence of under-normalized mantissas may mean bits are used inefficiently in an encoded signal or a value is represented less accurately, but the existence of over-normalized mantissas usually means values are badly distorted.

(3) Other Considerations for Normalization

In many implementations, the exponent is represented by a fixed number of bits or, alternatively, is constrained to have value within a prescribed range. If the bit length of the mantissa is longer than the maximum possible exponent value, the mantissa is capable of expressing a value that cannot be normalized. For example, if the exponent is represented by three bits, it can express any value from zero to seven. If the mantissa is represented by sixteen bits, the smallest non-zero value that it is capable of representing requires fourteen bit shifts for normalization. The 3-bit exponent clearly cannot express the value needed to normalize this mantissa value. This situation does not affect the basic principles upon which the present invention is based but practical implementations should ensure that arithmetic operations do not shift mantissas beyond the range that the associated exponent is capable of representing.

It is generally very inefficient to represent each spectral component in an encoded signal with its own mantissa and exponent. Fewer exponents are needed if multiple mantissas share a common exponent. This arrangement is sometimes referred to as a block-floating-point (BFP) representation. The value of the exponent for the block is established so that the value with largest magnitude in the block is represented by a normalized mantissa.

Fewer exponents, and as a result fewer bits to express the exponents, are needed if larger blocks are used. The use of larger blocks will, however, usually cause more values in the block to be under-normalized. The size of the block, therefore, is usually chosen to balance a trade off between the number of bits needed to convey exponents and the resulting inaccuracies and inefficiencies of representing under-normalized mantissas.

The choice of block size can also affect other aspects of coding such as the accuracy of the masking curve calculated by a perceptual model used in the quantizing controller 14. In some implementations, the perceptual model uses BFP exponents as an estimate of spectral shape to calculate a masking curve. If very large blocks are used for BFP, the spectral resolution of the BFP exponent is reduced and the accuracy of the masking curve calculated by the perceptual model is degraded. Additional details may be obtained from the A/52 Document.

The consequences of using BFP representations are not discussed in the following description. It is sufficient to understand that when BFP representations are used, it is very likely that some spectral components will be always be under-normalized.

(4) Quantization

The quantization of a spectral component represented in floating-point form generally refers to a quantization of the mantissa. The exponent generally is not quantized but is represented by a fixed number of bits or, alternatively, is constrained to have a value within a prescribed range.

If the normalized mantissa m=0.101101 shown in Table I is quantized to a resolution of $0.0625=0.0001_2$ then the quantized mantissa q(m) is equal to the binary fraction $0.1011_2$, which can be represented by five bits and is equal to the decimal fraction 0.6875. The value represented by the floating-point representation after being quantized to this particular resolution is $q(m)\cdot 2^{-x}=0.6875\times 0.25=0.171875$.

If the normalized mantissa shown in the table is quantized to a resolution of $0.25=0.01_2$ then the quantized mantissa is equal to the binary fraction $0.10_2$, which can be represented by three bits and is equal to the decimal fraction 0.5. The value represented by the floating-point representation after being quantized to this coarser resolution is $q(s)=0.5\times 0.25=0.125$.

These particular examples are provided merely for convenience of explanation. No particular form of quantization and no particular relationship between the quantizing resolution and the number of bits required to represent a quantized mantissa is important in principle to the present invention.

(5) Arithmetic Operations

Many processors and other hardware logic implement a special set of arithmetic operations that can be applied directly to a floating-point representation of numbers. Some processors and processing logic do not implement such operations and it is sometimes attractive to use these types of processors because they are usually much less expensive. When using such processors, one method of simulating floating-point operations is to convert the floating-point representations to extended-precision fixed-point fractional representations, perform integer arithmetic operations on the converted values, and re-convert back to floating-point representations. A more efficient method is to perform integer arithmetic operations on the mantissas and exponents separately.

By considering the effects these arithmetic operations may have on the mantissas, an encoding transmitter may be able to modify its encoding processes so that over-normalization and under-normalization in a subsequent decoding process can be controlled or prevented as desired. If over-normalization or under-normalization of a spectral component mantissa occurs in a decoding process, the decoder cannot correct this situation without also changing the value of the associated exponent.

This is particularly troublesome for the transcoder 30 because a change in an exponent means the complex processing of a quantizing controller is needed to determine the control parameters for transcoding. If the exponent of a spectral component is changed, one or more of the control parameters that are conveyed in the encoded signal may no longer be valid and may need to be determined again unless the encoding process that determined these control parameters was able to anticipate the change.

The effects of addition, subtraction and multiplication are of particular interest because these arithmetic operations are used in coding techniques like those discussed below.

(a) Addition

The addition of two floating-point numbers may be performed in two steps. In the first step, the scaling of the two numbers is harmonized if necessary. If the exponents of the two numbers are not equal, the bits of the mantissa associated with the larger exponent are shifted to the right by a number equal to the difference between the two exponents. In the second step, a "sum mantissa" is calculated by adding the mantissas of the two numbers using two's complement arithmetic. The sum of the two original numbers is then represented by the sum mantissa and the smaller exponent of the two original exponents.

At the conclusion of the addition operation, the sum mantissa may be over-normalized or under-normalized. If the sum of the two original mantissas equals or exceeds +1 or is less than −1, the sum mantissa will be over-normalized. If the sum of the two original mantissas is less than +0.5 and greater than or equal to −0.5, the sum mantissa will be under-normalized. This latter situation can arise if the two original mantissas have opposite signs.

(b) Subtraction

The subtraction of two floating-point numbers may be performed in two steps in a way that is analogous to that described above for addition. In the second step, a "difference mantissa" is calculated by subtracting one original mantissa from the other original mantissa using two's complement arithmetic. The difference of the two original numbers is then represented by the difference mantissa and the smaller exponent of the two original exponents.

At the conclusion of the subtraction operation, the difference mantissa may be over-normalized or under-normalized. If the difference of the two original mantissas is less than +0.5 and greater than or equal to −0.5, the difference mantissa will be under-normalized. If the difference of the two original mantissas equals or exceeds +1 or is less than −1, the difference mantissa will be over-normalized. This latter situation can arise if the two original mantissas have opposite signs.

(c) Multiplication

The multiplication of two floating-point numbers may be performed in two steps. In the first step, a "sum exponent" is calculated by adding the exponents of the two original numbers. In the second step, a "product mantissa" is calculated by multiplying the mantissas of the two numbers using two's complement arithmetic. The product of the two original numbers is then represented by the product mantissa and the sum exponent.

At the conclusion of the multiplication operation, the product mantissa may be under-normalized but, with one exception, can never be over-normalized because the magnitude of the product mantissa can never be greater than or equal to +1 or less than −1. If the product of the two original mantissas is less than +0.5 and greater than or equal to −0.5, the sum mantissa will be under-normalized.

The one exception to the rule for over-normalization occurs when both floating-point numbers to be multiplied have mantissas equal to −1. In this case, the multiplication produces a product mantissa equal to +1, which is over-normalized. This situation can be prevented, however, by ensuring at least one of the values to be multiplied is never negative. For the synthesis techniques discussed below, multiplication is used only for synthesizing signals from coupled-channel signals and for spectral regeneration. The exceptional condition is avoided in coupling by requiring the coupling coefficient to be a non-negative value, and it is avoided for spectral regeneration by requiring the envelope scaling information, the translated component blending parameter and the noise-like component blending parameter to be non-negative values.

The remainder of this discussion assumes coding techniques are implemented to avoid this one exceptional condition. If this condition cannot be avoided, steps must be taken to also avoid over-normalization when multiplication is used.

(d) Summary

The effect of these operations on mantissas can be summarized as follows:

(1) the addition of two normalized numbers can yield a sum that may be normalized, under-normalized, or over-normalized;

(2) the subtraction of two normalized numbers can yield a difference that may be normalized, under-normalized, or over-normalized; and (3) the multiplication of two normalized numbers can yield a product that may be normalized or under-normalized but, in view of the limitations discussed above, cannot be over-normalized.

The value obtained from these arithmetic operations can be expressed with fewer bits if it is normalized. Mantissas that are under-normalized are associated with an exponent that is less than the ideal value for a normalized mantissa; an integer expression of the under-normalized mantissa will lose accuracy as significant bits are lost from the least-significant bit positions. Mantissas that are over-normalized are associated with an exponent that is greater than the ideal value for a normalized mantissa; an integer expression of the over-normnalized mantissa will introduce distortion as significant bits are shifted from the most-significant bit positions into the sign bit position. The way in which some coding techniques affect normalization is discussed below.

3. Coding Techniques

Some applications impose severe limits on the infomation capacity of an encoded signal that cannot be met by basic perceptual encoding techniques without inserting unacceptable levels of quantization noise into the decoded signal. Additional coding techniques can be used that also degrade the quality of the decoded signal but do so in a way that reduces quantization noise to an acceptable level. Some of these coding techniques are discussed below.

a) Matrixing

Matrixing can be used to reduce information capacity requirements in two-channel coding systems if the signals in the two channels are highly correlated. By matrixing two correlated signals into sum and difference signals, one of the two matrixed signals will have an information capacity requirement that is about the same as one of the two original signals but the other matrixed signal will have a much lower information capacity requirement. If the two original signals are perfectly correlated, for example, the information capacity requirement for one of the matrixed signals will approach zero.

In principle, the two original signals can be recovered perfectly from the two matrixed sum and difference signals; however, quantization noise inserted by other coding techniques will prevent perfect recovery. Problems with matrixing that can be caused by quantization noise are not pertinent to an understanding of the present invention and are not discussed further. Additional details may be obtained from other references such as U.S. Pat. No. 5,291,557, and Vernon, "Dolby Digital: Audio Coding for Digital Television and Storage Applications," Audio Eng. Soc. 17th International Conference, Aug. 1999, pp. 40-57. See especially pp. 50-51.

A typical matrix for encoding a two-channel stereophonic program is shown below. Preferably, matrixing is applied adaptively to spectral components in subband signals only if the two original subband signals are deemed to be highly correlated. The matrix combines the spectral components of the left and right input channels into spectral components of sum- and difference-channel signals as follows:

$$M_i = \tfrac{1}{2}(L_i + R_i) \tag{3a}$$

$$D_i = \tfrac{1}{2}(L_i - R_i) \tag{3b}$$

where $M_i$=spectral component i in the sum-channel output of the matrix;

$D_i$=spectral component i in the difference-channel output of the matrix;

$L_i$=spectral component i in the left channel input to the matrix; and $R_i$=spectral component i in the right channel input to the matrix.

The spectral components in the sum- and difference-channel signals are encoded in a similar manner to that used for spectral components in signals that are not matrixed. In situations where the subband signals for the left- and right-channels are highly correlated and in phase, the spectral components in the sum-channel signal have magnitudes that are about the same as the magnitudes of the spectral components in the left- and right-channels, and the spectral components in the difference-channel signal will be substantially equal to zero. If the subband signals for the left- and right-channels are highly correlated and inverted in phase with respect to one another, this relationship between spectral component magnitudes and the sum- and difference-channel signals is reversed.

If matrixing is applied to subband signals adaptively, an indication of the matrixing for each frequency subband is included in the encoded signal so that the receiver can determine when a complementary inverse matrix should be used. The receiver independently processes and decodes the subband signals for each channel in the encoded signal unless an indication is received that indicates the subband signals were matrixed. The receiver can reverse the effects of matrixing and recover spectral components of the left- and right-channel subband signals by applying an inverse matrix as follows:

$$L'_i = M_i + D_i \tag{4a}$$

$$R'_i = M_i - D_i \tag{4b}$$

where $L'_i$=spectral component i in the recovered left channel output of the matrix; and $R'_i$=spectral component i in the recovered right channel output of the matrix.

In general, the recovered spectral components are not exactly equal to the original spectral components because of quantization effects.

If the inverse matrix receives spectral components with mantissas that are normalized, the addition and subtraction operations in the inverse matrix may result in recovered spectral components with mantissas that are under-normalized or over-normalized as explained above.

This situation is more complicated if the receiver synthesizes substitutes for one or more spectral components in matrixed subband signals. The synthesis process usually creates spectral component values that are uncertain. This uncertainty makes it impossible to determine in advance which spectral components from the inverse matrix will be over-normalized or under-normalized unless the total effects of the synthesis process are known in advance.

b) Coupling

Coupling may be used to encode spectral components for multiple channels. In preferred implementations, coupling is restricted to spectral components in higher-frequency subbands; however, in principle coupling may be used for any portion of the spectrum.

Coupling combines spectral components of signals in multiple channels into spectral components of a single coupled-channel signal and encodes information that represents the coupled-channel signal rather than encode information that represents the original multiple signals. The encoded signal also includes side information that represents the spectral shape of the original signals. This side information enables the receiver to synthesize multiple signals from the coupled-channel signal that have substantially the same spectral shape as the original multiple channel signals. One way in which coupling may be performed is described in the A/52 Document.

The following discussion describes one simple implementation in which coupling may be performed. According to this implementation, the spectral components of the coupled-channel are formed by calculating the average value of the corresponding spectral components in the multiple channels. This side information that represents the spectral shape of the original signals is referred to as coupling coordinates. A coupling coordinate for a particular channel is calculated from the ratio of spectral component energy in that particular channel to the spectral component energy in the coupled-channel signal.

In a preferred implementation, both spectral components and the coupling coordinates are conveyed in the encoded signal as floating-point numbers. The receiver synthesizes multiple channel signals from the coupled-channel signal by multiplying each spectral component in the coupled-channel signal with the appropriate coupling coordinate. The result is a set of synthesized signals that have the same or substantially the same spectral shape as the original signals. This process can be represented as follows:

$$s_{i,j}=C_i \cdot cc_{i,j} \tag{5}$$

where $s_{i,j}$=synthesized spectral component i in channel j;

$C_i$=spectral component i in the coupled-channel signal; and $cc_{i,j}$=coupling coordinate for spectral component i in channel j.

If the coupled-channel spectral component and the coupling coordinate are represented by floating-point numbers that are normalized, the product of these two numbers will result in a value represented by a mantissa that may be under-normalized but can never be over-normalized for reasons that are explained above.

This situation is more complicated if the receiver synthesizes substitutes for one or more spectral components in the coupled-channel signal. As mentioned above, the synthesis process usually creates spectral component values that are uncertain and this uncertainty makes it impossible to determine in advance which spectral components from the multiplication will be under-normalized unless the total effects of the synthesis process are known in advance.

c) Spectral Regeneration

In coding systems that use spectral regeneration, an encoding transmitter encodes only a baseband portion of an input audio signal and discards the rest. The decoding receiver generates a synthesized signal to substitute for the discarded portion. The encoded signal includes scaling information that is used by the decoding process to control signal synthesis so that the synthesized signal preserves to some degree the spectral levels of the portion of the input audio signal that is discarded.

Spectral components may be regenerated in a variety of ways. Some ways use a pseudo-random number generator to generate or synthesize spectral components. Other ways translate or copy spectral components in the baseband signal into portions of the spectrum that need regeneration. No particular way is important to the present invention; however, descriptions of some preferred implementations may be obtained from the references cited above.

The following discussion describes one simple implementation of spectral component regeneration. According to this implementation, a spectral component is synthesized by copying a spectral component from the baseband signal, combining the copied component with a noise-like component generated by a pseudo-random number generator, and scaling the combination according to scaling information conveyed in the encoded signal. The relative weights of the copied component and the noise-like component are also adjusted according to a blending parameter conveyed in the encoded signal. This process can be represented by the following expression:

$$s_i=e_i \cdot [a_i \cdot T_i+b_i \cdot N_i] \tag{6}$$

where $s_i$=the synthesized spectral component i;

$e_i$=envelope scaling information for spectral component i;

$T_i$=the copied spectral component for spectral component i;

$N_i$=the noise-like component generated for spectral component i;

$a_i$=the blending parameter for translated component $T_i$; and $b_i$=the blending parameter for noise-like component $N_i$.

If the copied spectral component, envelope scaling information, noise-like component and blending parameter are represented by floating-point numbers that are normalized, the addition and multiplication operations needed to generate the synthesized spectral component will produce a value represented by a mantissa that may be under-normalized normalized or over-normalized for reasons that are explained above. It is not possible to determine in advance which synthesized spectral components will be under-normalized or over-normalized unless the total effects of the synthesis process are known in advance.

B. Improved Techniques

The present invention is directed toward techniques that allow transcoding of perceptually encoded signals to be performed more efficiently and to provide higher-quality transcoded signals. This is accomplished by eliminating some functions from the transcoding process like analysis and synthesis filtering that are required in conventional encoding transmitters and decoding receivers. In its simplest form, transcoding according to the present invention performs a partial decoding process only to the extent needed to dequantize spectral information and it performs a partial encoding process only to the extent needed to re-quantize the dequantized spectral information. Additional decoding and encoding may be performed if desired. The transcoding process is further simplified by obtaining the control parameters needed for controlling dequantization and re-quantization from the encoded signal. The following discussion describes two methods that the encoding transmitter can use to generate the control parameters needed for transcoding.

1. Worst-Case Assumptions a) Overview

The first method for generating control parameters assumes worst-case conditions and modifies floating-point exponents only to the extent necessary to ensure over-normalization can never occur. Some unnecessary under-normalization is expected. The modified exponents are used by the quantizing controller 14 to determine the one or more second control parameters. The modified exponents do not need to be included in the encoded signal because the transcoding process also modifies the exponents under the same conditions and it modifies the mantissas that are associated with the modified exponents so that the floating-point representation expresses the correct value.

Figure 4:
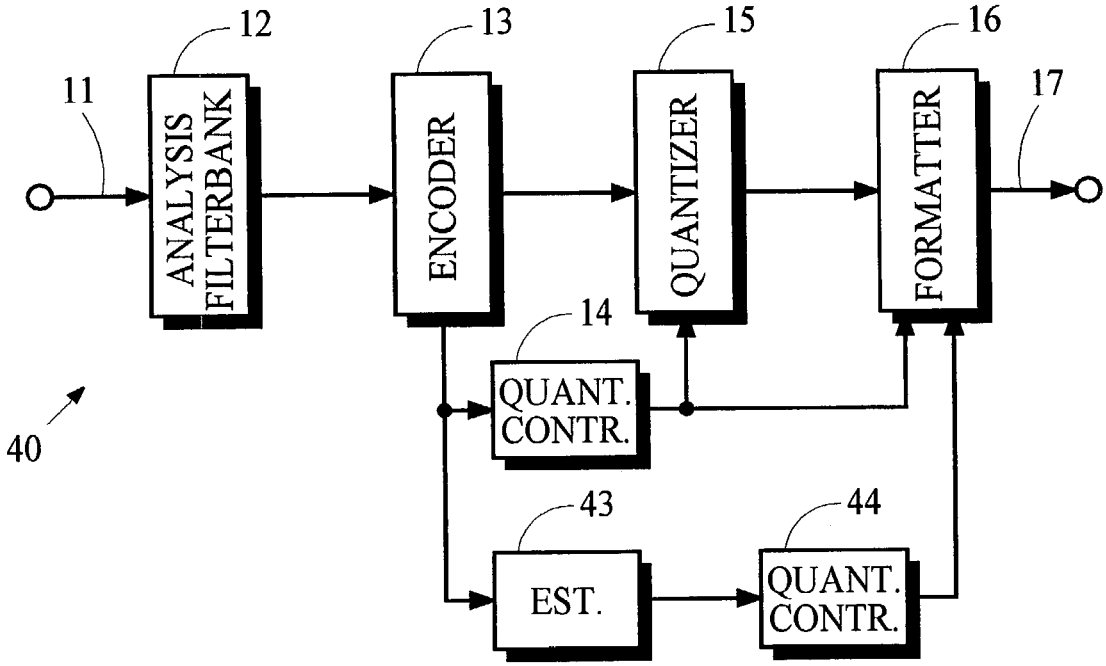
FIGS. 4 and 5 are schematic diagrams of audio encoding transmitters that incorporate various aspects of the present invention.

Referring to FIGS. 2 and 4, the quantizing controller 14 determines one or more first control parameters as described above, and the estimator 43 analyzes the spectral components with respect to the synthesis process of the decoder 24 to identify which exponents must be modified to ensure over-normalization does not occur in the synthesis process. These exponents are modified and passed with other unmodified exponents to the quantizing controller 44, which determines one or more second control parameters for a re-encoding process to be performed in the transcoder 30. The estimator 43 needs to consider only arithmetic operations in the synthesis process that may cause over-normalization. For this reason, synthesis processes for coupled-channel signals like that described above do not need to be considered because, as explained above, this particular process does not cause over-normalization. Arithmetic operations in other implementations of coupling may need to be considered.

b) Details of Processing (1) Matrixing

In matrixing, the exact value of each mantissa that will be provided to the inverse matrix cannot be known until after quantization is performed by the quantizer 15 and any noise-like component generated by the decoding process has been synthesized. In this implementation, the worst case must be assumed for each matrix operation because the mantissa values are not known. Referring to equations 4a and 4b, the worst case operation in the inverse matrix is either the addition of two mantissas having the same sign and magnitudes large enough to add to a magnitude greater than one, or the subtraction of two mantissas having different signs and magnitudes large enough to add to a magnitude greater than one. Over-normalization can be prevented in the transcoder for either worst-case situation by shifting each mantissa one bit to the right and reducing their exponents by one; therefore, the estimator 43 decrements the exponents for each spectral component in the inverse matrix calculation and the quantizing controller 44 uses these modified exponents to determine the one or more second control parameters for the transcoder. It is assumed here and throughout the remainder of this discussion that the values of the exponents prior to modification are greater than zero.

If the two mantissas that are actually provided to the inverse matrix do conform to the worst-case situation, the result is a properly normalized mantissa. If the actual mantissas do not conform to the worst-case situation, the result will be an under-normalized mantissa.

(2) Spectral Regeneration (HFR)

In spectral regeneration, the exact value of each mantissa that will be provided to the regeneration process cannot be known until after quantization is performed by the quantizer 15 and any noise-like component generated by the decoding process has been synthesized. In this implementation, the worst case must be assumed for each arithmetic operation because the mantissa values are not known. Referring to equation 6, the worst case operation is the addition of mantissas for a translated spectral component and a noise-like component having the same sign and magnitudes large enough to add to a magnitude greater than one. The multiplication operations cannot cause over-normalization but they also cannot assure over-normalization does not occur; therefore, it must be assumed that the synthesized spectral component is over-normalized. Over-normalization can be prevented in the transcoder by shifting the spectral component mantissa and the noise-like component mantissa one bit to the right and reducing exponents by one; therefore, the estimator 43 decrements the exponent for the translated component and the quantizing controller 44 uses this modified exponent to determine the one or more second control parameters for the transcoder.

If the two mantissas that are actually provided to the regeneration process do conform to the worst-case situation, the result is a properly normalized mantissa. If the actual mantissas do not conform to the worst-case situation, the result will be an under-normalized mantissa.

c) Advantages and Disadvantage

This first method that makes worst-case assumptions can be implemented inexpensively. It does, however, require the transcoder to force some spectral components to be under-normalized and conveyed less accurately in its encoded signal unless more bits are allocated to represent them. Furthermore, because the value of some exponents are decreased, masking curves based on these modified exponents are less accurate.

2. Deterministic Processes a) Overview

The second method for generating control parameters carries out a process that allows specific instances of over-normalization and under-normalization to be determined. Floating-point exponents are modified to prevent over-normalization and to minimize the occurrences of under-normalization. The modified exponents are used by the quantizing controller 14 to determine the one or more second control parameters. The modified exponents do not need to be included in the encoded signal because the transcoding process also modifies the exponents under the same conditions and it modifies the mantissas that are associated with the modified exponents so that the floating-point representation expresses the correct value.

Figure 5:
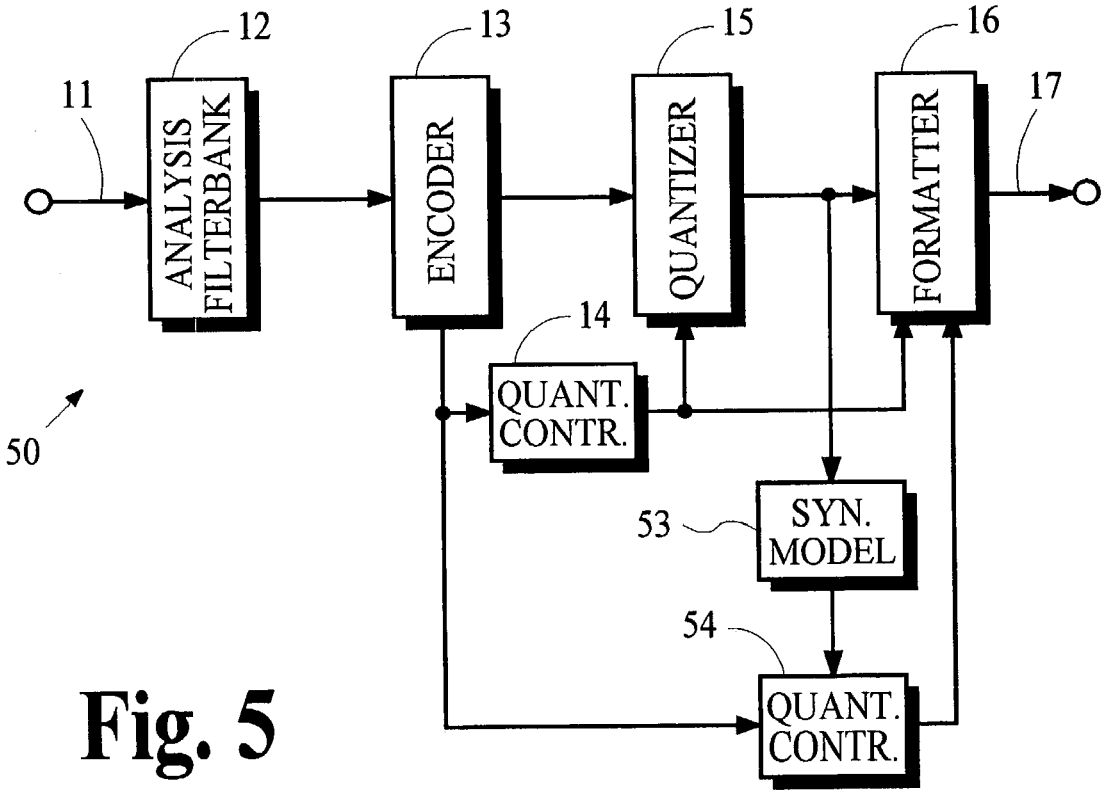

Referring to FIGS. 2 and 5, the quantizing controller 14 determines one or more first control parameters as described above, and the synthesis model 53 analyzes the spectral components with respect to the synthesis process of the decoder 24 to identify which exponents must be modified to ensure over-normalization does not occur in the synthesis process and to minimize the occurrences of under-normalization that occur in the synthesis process. These exponents are modified and passed with other unmodified exponents to the quantizing controller 54, which determines one or more second control parameters for a re-encoding process to be performed in the transcoder 30. The synthesis model 53 performs all or parts of the synthesis process or it simulates its effects to allow the effects on normalization of all arithmetic operations in the synthesis process to be determined in advance.

The value of each quantized mantissa and any synthesized component must be available to the analysis process that is performed in the synthesis model 53. If the synthesis processes uses a pseudo-random number generator or other quasi-random process, initialization or seed values must be synchronized between the transmifter's analysis process and the receiver's synthesis process. This can be accomplished by having the transmitting encoder 10 determine all initialization values and include some indication of these values in the encoded signal. If the encoded signal is arranged in independent intervals or frames, it may be desirable to include this information in each frame to minimize startup delays in decoding and to facilitate a variety of program production activities like editing.

b) Details of Processing (1) Matrixing

In matrixing, it is possible that the decoding process used by the decoder 24 will synthesize one or both of the spectral components that are input to the inverse matrix. If either component is synthesized, it is possible for the spectral components calculated by the inverse matrix to be over-normalized or under-normalized. The spectral components calculated by the inverse matrix may also be over-normalized or under-normalized due to quantization errors in the mantissas. The synthesis model 53 can test for these unnormalized conditions because it can determine the exact value of the mantissas and exponents that are input to the inverse matrix.

If the synthesis model 53 determines that normalization will be lost, the exponent for one or both components that are input to the inverse matrix can be reduced to prevent over-normalization and can be increased to prevent under-normalization. The modified exponents are not included in the encoded signal but they are used by the quantizing controller 54 to determine the one or more second control parameters. When the transcoder 30 makes the same modifications to the exponents, the associated mantissas also will be adjusted so that the resultant floating-point numbers express the correct component values.

(2) Spectral Regeneration (HFR)

In spectral regeneration, it is possible that the decoding process used by the decoder 24 will synthesize the translated spectral component and it may also synthesize a noise-like component to be added to the translated component. As a result, it is possible for the spectral component calculated by the spectral regeneration process to be over-normalized or under-normalized. The regenerated component may also be over-normalized or under-normalized due to quantization errors in the mantissa of the translated component. The synthesis model 53 can test for these unnormalized conditions because it can determine the exact value of the mantissas and exponents that are input to the regeneration process.

If the synthesis model 53 determines that normalization will be lost, the exponent for one or both components that are input to the regeneration process can be reduced to prevent over-normalization and can be increased to prevent under-normalization. The modified exponents are not included in the encoded signal but they are used by the quantizing controller 54 to determine the one or more second control parameters. When the transcoder 30 makes the same modifications to the exponents, the associated mantissas also will be adjusted so that the resultant floating-point numbers express the correct component values.

(3) Coupling

In synthesis processes for coupled-channel signals, it is possible that the decoding process used by the decoder 24 will synthesize noise-like components for one or more of the spectral components in the coupled-channel signal. As a result, it is possible for spectral components calculated by the synthesis process to be under-normalized. The synthesized components may also be under-normalized due to quantization errors in the mantissa of the spectral components in the coupled-channel signal. The synthesis model 53 can test for these unnormalized conditions because it can determine the exact value of the mantissas and exponents that are input to the synthesis process.

If the synthesis model 53 determines that normalization will be lost, the exponent for one or both components that are input to the synthesis process can be increased to prevent under-normalization. The modified exponents are not included in the encoded signal but they are used by the quantizing controller 54 to determine the one or more second control parameters. When the transcoder 30 makes the same modifications to the exponents, the associated mantissas also will be adjusted so that the resultant floating-point numbers express the correct component values.

c) Advantages and Disadvantages

The processes that perform the deterministic method are more expensive to implement than those that perform the worst-case estimation method; however, these additional implementation costs pertain to the encoding transmitters and allow transcoders to be implemented much less expensively. In addition, inaccuracies that are caused by unnormalized mantissas can be avoided or minimized and masking curves based on exponents that are modified according to the deterministic method are more accurate than the masking curves that are calculated in the worst-case estimation method.

C. Implementation

Figure 6:
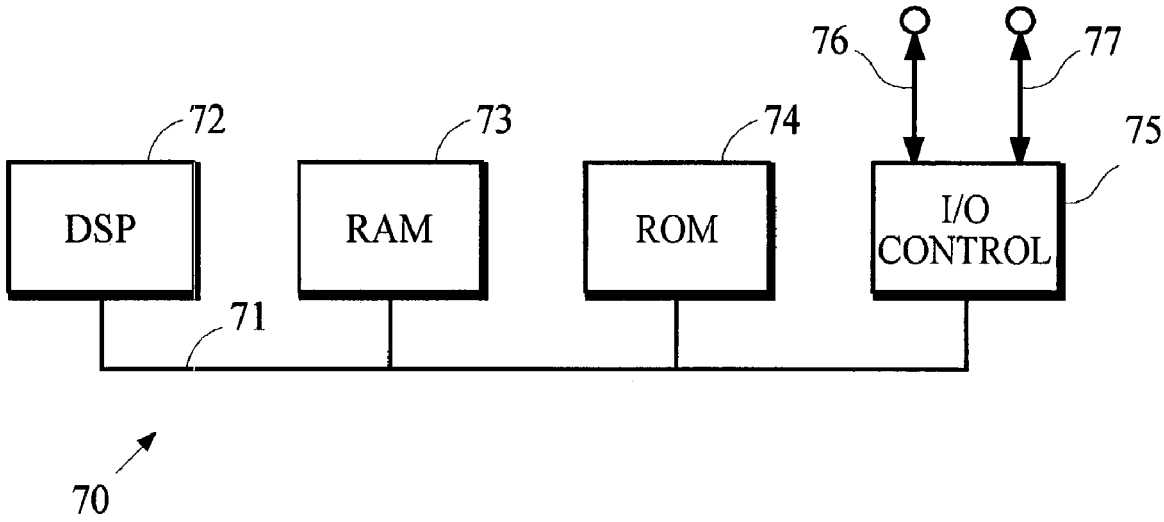
FIG. 6 is a schematic block diagram of an apparatus that can implement various aspects of the present invention.

Various aspects of the present invention may be implemented in a variety of ways including software for execution by a computer or some other apparatus that includes more specialized components such as a digital signal processor (DSP) circuitry coupled to components similar to those found in a general-purpose computer. FIG. 6 is a block diagram of device 70 that may be used to implement aspects of the present invention. DSP 72 provides computing resources. RAM 73 is system random access memory (RAM) used by DSP 72 for signal processing. ROM 74 represents some form of persistent storage such as read only memory (ROM) for storing programs needed to operate device 70 and to carry out various aspects of the present invention. I/O control 75 represents interface circuitry to receive and transmit signals by way of communication channels 76, 77. Analog-to-digital converters and digital-to-analog converters may be included in I/O control 75 as desired to receive and/or transmit analog audio signals. In the embodiment shown, all major system components connect to bus 71, which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk, or an optical medium. The storage medium maybe used to record programs of instructions for operating systems, utilities and applications, and may include embodiments of programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media like paper.

The invention claimed is:

1. A method of processing an audio signal comprising:

receiving a signal conveying initial scaled values and initial scale factors representing spectral components of the audio signal, wherein each initial scale factor is associated with one or more initial scaled values, each initial scaled value is scaled according to its associated initial scale factor, and each initial scaled value and associated initial scale factor represent the value of a respective spectral component;

generating coded spectral information by pertforming a coding process that is responsive to initial spectral information that comprises at least some of the initial scale factors;

deriving one or more first control parameters in response to the initial scale factors and a first bit-rate requirement;

allocating bits according to a first bit allocation process in response to the one or more first control parameters;

obtaining quantized scaled values by quantizing at least some of the initial scaled values using quantizing resolutions based on numbers of bits allocated by the first bit allocation process;

deriving one or more second control parameters in response to at least some of the initial scale factors, one or more modified scale factors and a second bit-rate requirement, wherein the one or more modified scale factors are obtained by:

analyzing the initial spectral information with respect to a synthesis process to be applied to the coded spectral information in a decoding method that generates synthesized spectral components represented by synthesized scaled values and associated synthesized scale factors to identify one or more potentially unnormalized synthesized scaled values, wherein the synthesis process is quasi-inverse to the coding process, and generating the one or more modified scale factors to represent modified values of initial scale factors in the initial spectral information corresponding to synthesized scale factors that are associated with at least some of the one or more potentially unnormalized synthesized scaled values to compensate for loss of normalization of the identified potentially unnormalized synthesized scaled values; and assembling encoded information into an encoded signal, wherein the encoded information represents the quantized scaled values, at least some of the initial scale factors, the coded spectral information, the one or more first control parameters and the one or more second control parameters.

2. A method according to claim 1 wherein the coding process performs one or more coding techniques from the set of matrixing, coupling and scale factor formation for spectral component regeneration.

3. A method according to claim 1 wherein:

the coded spectral information comprises coded scaled values associated with initial scale factors or associated with coded scale factors in the coded spectral information generated by the coding process, the one or more control parameters are derived also in response to at least some of the coded scale factors, and the quantized scaled values are obtained by also quantizing at least some of the coded scaled values using quantizing resolutions based on numbers of bits allocated by the first bit allocation process.

4. A method according to claim 1 wherein scaled values are floating-point mantissas and scale factors are floating-point exponents.

5. A method according to claim 1 wherein the initial spectral information is analyzed with respect to the synthesis process under worst-case assumptions to identify all potentially over-normalized synthesized scaled values.

6. A method according to claim 5 wherein modified scale factors are generated to compensate for all occurrences of over-normalization of the potentially over-normalized synthesized scaled values.

7. A method according to claim 1 wherein the first bit rate is equal to the second bit rate.

8. A method according to claim 1 wherein the initial spectral information is analyzed by performing at least part of the synthesis process or an emulation of at least part of the synthesis process that is responsive to the coded spectral information and to at least some of the quantized scaled values to generate at least some of the synthesized spectral components, wherein the one or more potentially unnormalized synthesized scaled values are determined to be one or more unnormalized scaled values that result from the synthesis process.

9. A method according to claim 8 wherein all over-normalized synthesized scaled values are identified.

10. A method according to claim 9 wherein modified scale factors are generated to reflect a normalization ofall over-normalized synthesized scaled values and at least some under-normalized synthesized scaled values.

11. A method of transcoding encoded audio information comprising:

receiving a first encoded signal conveying first quantized scaled values and first scale factors representing spectral components of an audio signal in a first frequency band, and conveying one or more first control parameters and one or more second control parameters:

obtaining the first quantized scaled values and the first scale factors from the first encoded signal, wherein each first scale factor is associated with one or more first quantized scaled values, each first quantized scaled value is scaled according to its associated first scale factor, and each first quantized scaled value and associated first scale factor represent a respective spectral component;

obtaining the one or more first control parameters and the one or more second control parameters from the first encoded signal, wherein the one or more first control parameters were derived in response to a first bit-rate requirement for the first encoded signal and the one or more second control parameters were derived in response to a second bit-rate requirement for a second encoded signal that is not equal to the first bit rate;

allocating bits according to a first bit allocation process in response to the one or more first control parameters and obtaining dequantized scaled values by dequantizing the first quantized scaled values according to quantizing resolutions based on numbers of bits allocated by the first bit allocation process;

generating synthesized spectral components from the dequantized scaled values, wherein the synthesized spectral components represent spectral content in a second frequency band outside the first frequency band;

generating one or more second scale factors for the synthesized spectral components and generating one or more second scaled values, wherein each second scale factor is associated with one or more second scaled values and each second scaled value is scaled according to its associated second scale factor;

allocating bits according to a second bit allocation process in response to the one or more second control parameters and obtaining second quantized scaled values by quantizing the dequantized scaled values and the second scaled values using quantizing resolutions based on numbers of bits allocated by the second bit allocation process; and assembling the second quantized scaled values, the second scale factors and the one or more second control parameters into the second encoded signal.

12. A method according to claim 11 that comprises;

using the one or more first control parameters to obtain a first allowable quantizing noise threshold;

quantizing the first quantized values with quantizing resolutions established according to the first allowable quantizing noise threshold;

using the one or more second control parameters to obtain a second allowable quantizing noise threshold that differs from the first allowable quantizing noise threshold; and quantizing the second quantized values with quantizing resolutions established according to the second allowable quantizing noise threshold.

13. An encoder for processing an audio signal, wherein the encoder comprises:

means for receiving a signal conveying initial scaled values and initial scale factors representing spectral components of the audio signal, wherein each initial scale factor is associated with one or more initial scaled values, each initial scaled value is scaled according to its associated initial scale factor, and each initial scaled value and associated initial scale factor represent the value of a respective spectral component;

means for generating coded spectral information by performing a coding process that is responsive to initial spectral information that comprises at least some of the initial scale factors;

means for deriving one or more first control parameters in response to the initial scale factors and a first bit-rate requirement;

means for allocating bits according to a first bit allocation process in response to the one or more first control parameters;

means for obtaining quantized scaled values by quantizing at least some of the initial scaled values using quantizing resolutions based on numbers of bits allocated by the first bit allocation process;

means for deriving one or more second control parameters in response to at least some of the initial scale factors, one or more modified scale factors and a second bit-rate requirement, wherein the one or more modified scale factors are obtained by:

analyzing the initial spectral information with respect to a synthesis process to be applied to the coded spectral information in a decoding method that generates synthesized spectral components represented by synthesized scaled values and associated synthesized scale factors to identify one or more potentially unnormalized synthesized scaled values, wherein the synthesis process is quasi-inverse to the coding process, and generating the one or more modified scale factors to represent modified values of initial scale factors in the initial spectral information corresponding to synthesized scale factors that are associated with at least some of the one or more potentially unnormalized synthesized scaled values to compensate for loss of normalization of the identified potentially unnormalized synthesized scaled values; and means for assembling encoded information into an encoded signal, wherein the encoded information represents the quantized scaled values, at least some of the initial scale factors, the coded spectral information, the one or more first control parameters and the one or more second control parameters.

14. An encoder according to claim 13 wherein the coding process performs one or more coding techniques from the set of matrixing, coupling and scale factor formation for spectral component regeneration.

15. An encoder according to claim 13 wherein:

the coded spectral information comprises coded scaled values associated with initial scale factors or associated with coded scale factors in the coded spectral information generated by the coding process, the one or more control parameters are derived also in response to at least some of the coded scale factors, and the quantized scaled values are obtained by also quantizing at least some of the coded scaled values using quantizing resolutions based on numbers of bits allocated by the first bit allocation process.

16. An encoder according to claim 13 wherein scaled values are floating-point mantissas and scale factors are floating-point exponents.

17. An encoder according to claim 13 wherein the initial spectral information is analyzed with respect to the synthesis process under worst-case assumptions to identify all potentially over-normalized synthesized scaled values.

18. An encoder according to claim 17 wherein modified scale factors are generated to compensate for all occurrences of over-normalization of the potentially over-normalized synthesized scaled values.

19. An encoder according to claim 13 wherein the first bit rate is equal to the second bit rate.

20. An encoder according to claim 13 wherein the initial spectral information is analyzed by performing at least part of the synthesis process or an emulation of at least part of the synthesis process that is responsive to the coded spectral information and to at least some of the quantized scaled values to generate at least some of the synthesized spectral components, wherein the one or more potentially unnormalized synthesized scaled values are determined to be one or more unnormalized scaled values that result from the synthesis process.

21. An encoder according to claim 20 wherein all over-normalized synthesized scaled values are identified.

22. An encoder according to claim 21 wherein modified scale factors are generated to reflect a normalization of all over-normalized synthesized scaled values and at least some under-normalized synthesized scaled values.

23. A transcoder for transcoding encoded audio information, wherein the transcoder comprises:

means for receiving a first encoded signal conveying first quantized sealed values and first scale factors representing spectral components of an audio signal in a first frequency band, and conveying one or more first control parameters and one or more second control parameters;

means for obtaining the first quantized scaled values and the first scale factors from the first encoded signal, wherein each first scale factor is associated with one or more first quantized scaled values, each first quantized scaled value is scaled according to its associated first scale factor, and each first quantized scaled value and associated first scale factor represent a respective spectral component;

means for obtaining the one or more first control parameters and the one or more second control parameters from the first encoded signal, wherein the one or more first control parameters were derived in response to a first bit-rate requirement for the first encoded signal and the one or more second control parameters were derived in response to a second bit-rate requirement for a second encoded signal that is not equal to the first bit rate;

means for allocating bits according to a first bit allocation process in response to the one or more first control parameters and obtaining dequantized scaled values by dequantizing the first quantized scaled values according to quantizing resolutions based on numbers of bits allocated by the first bit allocation process;

means for generating synthesized spectral components from the dequantized scaled values, wherein the synthesized spectral components represent spectral content in a second frequency band outside the first frequency band;

means for generating one or more second scale factors for the synthesized spectral components and for generating one or more second scaled values, wherein each second scale factor is associated with one or more second scaled values and each second scaled value is scaled according to its associated second scale factor;

means for allocating bits according to a second bit allocation process in response to the one or more second control parameters and obtaining second quantized scaled values by quantizing the dequantized scaled values and the second scaled values using quantizing resolutions based on numbers of bits allocated by the second bit allocation process; and means for assembling the second quantized sealed values, the second scale factors and the one or more second control parameters into the second encoded signal.

24. A method according to claim 23 that comprises:

means for using the one or more first control parameters to obtain a first allowable quantizing noise threshold;

means for quantizing the first quantized values with quantizing resolutions established according to the first allowable quantizing noise threshold;

means for using the one or more second control parameters to obtain a second allowable quantizing noise threshold that differs from the first allowable quantizing noise threshold; and means for quantizing the second quantized values with quantizing resolutions established according to the second allowable quantizing noise threshold.

25. A medium conveying a program or instructions executable by a device, wherein execution of the program of instructions causes the device to perform a method for transcoding audio information, wherein the method comprises:

receiving a signal conveying initial scaled values and initial scale factors representing spectral components of the audio signal, wherein each initial scale factor is associated with one or more initial scaled values, each initial scaled value is scaled according to its associated initial scale factor, and each initial scaled value and associated initial scale factor represent the value of a respective spectral component;

generating coded spectral information by performing a coding process that is responsive to initial spectral information that comprises at least some of the initial scale factors;

deriving one or more first control parameters in response to the initial scale factors and a first bit-rate requirement;

allocating bits according to a first bit allocation process in response to the one or more first control parameters;

obtaining quantized scaled values by quantizing at least some of the initial scaled values using quantizing resolutions based on numbers of bits allocated by the first bit allocation process;

deriving one or more second control parameters in response to at least some of the initial scale factors, one or more modified scale factors and a second bit-rate requirement, wherein the one or more modified scale factors are obtained by:

analyzing the initial spectral information with respect to a synthesis process to be applied to the coded spectral information in a decoding method that generates synthesized spectral components represented by synthesized scaled values and associated synthesized scale factors to identify one or more potentially unnormalized synthesized scaled values, wherein the synthesis process is quasi-inverse to the coding process, and generating the one or more modified scale factors to represent modified values of initial scale factors in the initial spectral information corresponding to synthesized scale factors that are associated with at least some of the one or more potentially unnormalized synthesized scaled values to compensate for loss of normalization of the identified potentially unnormalized synthesized scaled values; and assembling encoded information into an encoded signal, wherein the encoded information represents the quantized scaled values, at least some of the initial scale factors, the coded spectral information, the one or more first control parameters and the one or more second control parameters.

26. A medium according to claim 25 wherein the coding process performs one or more coding techniques from the set of matrixing, coupling and scale factor formation for spectral component regeneration.

27. A medium according to claim 25 wherein:

the coded spectral information comprises coded scaled values associated with initial scale factors or associated with coded scale factors in the coded spectral information generated by the coding process, the one or more control parameters are derived also in response to at least some of the coded scale factors, and the quantized sealed values are obtained by also quantizing at least some of the coded scaled values using quantizing resolutions based on numbers of bits allocated by the first bit allocation process.

28. A medium according to claim 25 wherein scaled values are floating-point mantissas and scale factors are floating-point exponents.

29. A medium according to claim 25 wherein the initial spectral information is analyzed with respect to the synthesis process under worst-case assumptions to identify all potentially over-normalized synthesized scaled values.

30. A medium according to claim 29 wherein modified scale factors are generated to compensate for all occurrences of over-normalization of the potentially over-normalized synthesized scaled values.

31. A medium according to claim 25 wherein the first bit rate is equal to the second bit rate.

32. A medium according to claim 25 wherein the initial spectral information is analyzed by performing at least part at the synthesis process or an emulation of at least part of the synthesis process that is responsive to the coded spectral information and to at least some of the quantized scaled values to generate at least some of the synthesized spectral components, wherein the one or more potentially unnormalized synthesized scaled values are determined to be one or more unnormalized scaled values that result from the synthesis process.

33. A medium according to claim 32 wherein all over-normalized synthesized scaled values are identified.

34. A medium according to claim 33 wherein modified scale factors are generated to reflect a normalization of all over-normalized synthesized scaled values and at least some under-normalized synthesized scaled values.

35. A medium conveying a program of instructions executable by a device, wherein execution of the program of instructions causes the device to perform a method for transcoding encoded audio information, wherein the method comprises:

receiving a first encoded signal conveying first quantized scaled values and first scale factors representing spectral components of an audio signal in a first frequency band, and conveying one or more first control parameters and one or more second control parameters;

obtaining the first quantized scaled values and the first scale factors from the first encoded signal, wherein each first scale factor is associated with one or more first quantized scaled values, each first quantized scaled value is scaled according to its associated first scale factor, and each first quantized scaled value and associated first scale factor represent a respective spectral component;

obtaining the one or more first control parameters and the one or more second control parameters from the first encoded signal, wherein the one or more first control parameters were derived in response to a first bit-rate requirement for the first encoded signal and the one or more second control parameters were derived in response to a second bit-rate requirement for a second encoded signal that is not equal to the first bit rate;

allocating bits according to a first bit allocation process in response to the one or more first control parameters and obtaining dequantized scaled values by dequantizing the first quantized scaled values according to quantizing resolutions based on numbers of bits allocated by the first bit allocation process;

generating synthesized spectral components from the dequantized scaled values, wherein the synthesized spectral components represent spectral content in a second frequency band outside the first frequency band;

generating one or more second scale factors for the synthesized spectral components and generating one or more second scaled values, wherein each second scale factor is associated with one or more second scaled values and each second scaled value is sealed according to its associated second scale factor;

allocating bits according to a second bit allocation process in response to the one or more second control parameters and obtaining second quantized scaled values by quantizing the dequantized scaled values and the second scaled values using quantizing resolutions based on numbers of bits allocated by the second bit allocation process; and assembling the second quantized scaled values, the second scale factors and the one or more second control parameters into the second encoded signal.

36. A medium according to claim 35, wherein the method comprises;

using the one or more first control parameters to obtain a first allowable quantizing noise threshold;

quantizing the first quantized values with quantizing resolutions established according to the first allowable quantizing noise threshold;

using the one or more second control parameters to obtain a second allowable quantizing noise threshold that differs from the first allowable quantizing noise threshold; and quantizing the second quantized values with quantizing resolutions established according to the second allowable quantizing noise threshold.

* * * * *

UNITED STATES PATENT AND TRADEMARK OFFICE

CERTIFICATE OF CORRECTION

PATENT NO. : 7,318,027 B2 
APPLICATION NO. : 10/458798
DATED : January 8, 2008
INVENTOR(S) : Brian Timothy Lennon, Michael Mead Truman and Robert Loring Andersen It is certified that error appears in the above-identified patent and that said Letters Patent is hereby corrected as shown below:

Column 24, line 4, "quantizing the first quantized values" should be --dequantizing the first quantized scaled values--.

Column 24, line 11, "quantized" should be --scaled--.

Column 26, line 28, "quantizing the first quantized values" should be --dequantizing the first quantized scaled values--.

Column 26, line 35, "quantized" should be --scaled--.

Column 28, line 55, "quantizing the first quantized values" should be --dequantizing the first quantized scaled values--.

Column 28, line 62, "quantized" should be --scaled--.

Signed and Sealed this

Twenty-seventh Day of October, 2009

David J. Kappos

David J. Kappos
*Director of the United States Patent and Trademark Office*